US010045635B2

(12) United States Patent
Mountz et al.

(10) Patent No.: US 10,045,635 B2
(45) Date of Patent: Aug. 14, 2018

(54) CHILD MOTION APPARATUS

(71) Applicant: Wonderland Nurserygoods Company Limited, Kwai Chung, N.T. (HK)

(72) Inventors: Jonathan K. Mountz, Birdsboro, PA (US); William B. Bellows, Wyomissing, PA (US)

(73) Assignee: Wonderland Switzerland AG (CH)

( * ) Notice: Subject to any disclaimer, the term of this patent is extended or adjusted under 35 U.S.C. 154(b) by 0 days.

(21) Appl. No.: 15/163,083

(22) Filed: May 24, 2016

(65) Prior Publication Data

US 2016/0345751 A1 Dec. 1, 2016

Related U.S. Application Data

(60) Provisional application No. 62/166,418, filed on May 26, 2015.

(51) Int. Cl.
*A47D 13/10* (2006.01)

(52) U.S. Cl.
CPC ..... *A47D 13/105* (2013.01)

(58) Field of Classification Search
CPC ..... A47D 1/00; A47D 13/10; A47D 13/105
See application file for complete search history.

(56) References Cited

U.S. PATENT DOCUMENTS 4,258,446 A 3/1981 McAllister et al.
6,540,292 B2 4/2003 Darling et al.
7,497,518 B2 3/2009 Fritz et al.
7,563,170 B2 7/2009 Bellows et al.
7,717,798 B2 5/2010 Bellows et al.
7,722,118 B2 5/2010 Bapst et al.
(Continued)

FOREIGN PATENT DOCUMENTS

CN 101378681 A 3/2009
CN 101548836 A 10/2009
(Continued)

OTHER PUBLICATIONS

Examination Report dated May 22, 2017 in co-pending German Appl. No. 10 2016 109 688.1.
(Continued)

*Primary Examiner* — Philip F Gabler
(74) *Attorney, Agent, or Firm* — Daniel A. Tallitsch; Baker McKenzie LLP

(57) ABSTRACT

A child motion apparatus includes a base frame assembly for providing standing support on a floor, a column assembled with the base frame assembly, a support arm extending generally horizontally relative to the column and having a first and a second end portion, a child seat connected with the second end portion of the support arm, a vertical actuating mechanism supported by the base frame assembly and operable to drive the column to slide upward and downward, and a horizontal actuating mechanism operable to drive the support arm to oscillate generally horizontally relative to the column. The first end portion of the support arm is assembled with the column and has a channel, and the horizontal actuating mechanism includes a driving part movable along a circular path and guided for sliding movement along the channel at the first end portion of the support arm.

36 Claims, 17 Drawing Sheets

(56) References Cited

U.S. PATENT DOCUMENTS

| | | | | |
|---|---|---|---|---|
| 7,770,971 | B2 | 8/2010 | Bellows et al. | |
| 7,824,273 | B2 * | 11/2010 | Clapper | A47D 9/02 472/119 |
| 7,837,570 | B2 | 11/2010 | Kwon | |
| 7,883,426 | B2 | 2/2011 | Bellows et al. | |
| 7,938,731 | B2 * | 5/2011 | Papageorge | A47D 9/02 297/250.1 |
| 8,029,377 | B2 | 10/2011 | Velderman et al. | |
| 8,197,005 | B2 | 6/2012 | Hopke et al. | |
| 8,239,984 | B2 | 8/2012 | Hopke et al. | |
| 8,602,903 | B2 | 12/2013 | Gilbert | |
| 8,661,582 | B2 | 3/2014 | Sclare et al. | |
| 8,684,856 | B2 | 4/2014 | Pyrce et al. | |
| 8,827,366 | B2 | 9/2014 | Hopke et al. | |
| 8,834,282 | B2 | 9/2014 | Sclare et al. | |
| 2007/0262627 | A1 | 11/2007 | Clapper et al. | |
| 2008/0136236 | A1 | 6/2008 | Kincaid et al. | |
| 2008/0179928 | A1 * | 7/2008 | Chen | A47D 13/10 297/260.1 |
| 2010/0127539 | A1 | 5/2010 | Bellows et al. | |
| 2012/0205954 | A1 | 8/2012 | Pollack et al. | |
| 2013/0184088 | A1 | 7/2013 | Haut | |
| 2013/0244803 | A1 * | 9/2013 | Haut | A47D 13/105 472/119 |
| 2014/0018179 | A1 * | 1/2014 | Mountz | A47D 9/02 472/119 |
| 2014/0057732 | A1 | 2/2014 | Gilbert | |
| 2014/0123386 | A1 | 5/2014 | Sclare et al. | |
| 2014/0315650 | A1 | 10/2014 | Pyrce et al. | |
| 2014/0339867 | A1 | 11/2014 | Hopke et al. | |
| 2015/0245719 | A1 * | 9/2015 | Zhong | A47D 13/10 297/260.2 |
| 2015/0250330 | A1 * | 9/2015 | Mountz | A47D 13/105 297/183.4 |

FOREIGN PATENT DOCUMENTS

| | | | |
|---|---|---|---|
| CN | 100591246 | C | 2/2010 |
| CN | 201822383 | U | 5/2011 |
| CN | 102170810 | A | 8/2011 |
| CN | 102727009 | A | 10/2012 |
| CN | 102894731 | A | 1/2013 |
| CN | 102894733 | A | 1/2013 |
| CN | 202681300 | U | 1/2013 |
| CN | 203506174 | U | 4/2014 |
| CN | 204048917 | U | 12/2014 |
| CN | 104273985 | A | 1/2015 |
| DE | 10 2013 107 411 | A1 | 1/2014 |
| EP | 1974634 | A1 | 1/2008 |
| EP | 2617329 | A1 | 7/2013 |
| EP | 2641511 | A1 | 9/2013 |
| EP | 1942773 | B1 | 6/2015 |
| GB | 2515943 | A | 7/2015 |
| JP | 2001-101801 | | 4/2001 |
| WO | 2007056690 | A2 | 5/2007 |

OTHER PUBLICATIONS

Search Report in co-pending UK Patent Application No. 1609155.5 dated Nov. 9, 2016.

Office Action in co-pending Japanese Patent Application No. 2016-104128 dated Jun. 16, 2017.

* cited by examiner

CHILD MOTION APPARATUS

CROSS-REFERENCE TO RELATED APPLICATION(S)

This application claims priority to U.S. Provisional Patent Application No. 62/166,418 filed on May 26, 2015, the disclosure of which is incorporated herein by reference.

BACKGROUND

1. Field of the Invention

The present invention relates to child motion apparatuses.

2. Description of the Related Art

Swing apparatuses can be used by parents to help calming or entertaining a child. A child swing apparatus typically travels at a natural frequency in a pendulum motion. The drive system for the swing apparatus is generally located at the pivot point of the pendulum at a high location in the frame structure of the swing apparatus. While the conventional pendulum motion requires being driven when the system has the highest torque rendered by the gravity, the system can store the potential energy from one half cycle to another, requiring only a soft push or pull to maintain or increase the amplitude.

However, a few drawbacks may exist in the conventional swing apparatuses. In particular, the swinging motion and frequency are generally locked as a function of the length of the swing arm. If a slower frequency of swinging motion is needed along a same motion path, it may be extremely difficult to exert a driving torque for overcoming the gravitational force acting in the pendulum motion. Accordingly, the drive systems applied in most of the pendulum swing apparatuses cannot allow truly adjustable swinging frequency and have a limited range of movement paths.

Therefore, there is a need for an improved child motion apparatus that can address at least the foregoing issues.

SUMMARY

The present application describes a child motion apparatus including two actuating mechanisms that are independently controllable for respectively imparting vertical movements and horizontal oscillating movements to a child seat. In one embodiment, the child motion apparatus includes a base frame assembly for providing standing support on a floor, a column assembled with the base frame assembly, a support arm extending generally horizontally relative to the column and having a first and a second end portion, a child seat connected with the second end portion of the support arm, a vertical actuating mechanism supported by the base frame assembly and operable to drive the column to slide upward and downward relative to the base frame assembly, and a horizontal actuating mechanism operable to drive the support arm to oscillate generally horizontally relative to the column. The first end portion of the support arm is assembled with the column and has a channel, and the horizontal actuating mechanism includes a driving part movable along a circular path and guided for sliding movement along the channel at the first end portion of the support arm.

According to another embodiment, the child motion apparatus includes a base frame assembly for providing standing support on a floor, a column connected with the base frame assembly, a support arm extending generally horizontally relative to the column, a child seat, a horizontal actuating mechanism and a vertical actuating mechanism. The support arm has a first and a second end portion, the first end portion being assembled with the column and having a first channel extending generally vertically, and the child seat being connected with the second end portion of the support arm. The horizontal actuating mechanism is operable to drive the support arm to oscillate generally horizontally relative to the column, the horizontal actuating mechanism including a first driving part movable along a first circular path and guided for sliding movement along the first channel. The vertical actuating mechanism is supported by the base frame assembly and is operable to drive the column to slide upward and downward relative to the base frame assembly, the vertical actuating mechanism including a second driving part movable along a second circular path and guided for sliding movement along a second channel affixed with the column, the second channel extending generally horizontally.

In yet another embodiment, the child motion apparatus includes a base frame assembly for providing standing support on a floor, a column connected with the base frame assembly, a support arm extending generally horizontally relative to the column, the support arm having a first and a second end portion, the first end portion being assembled with the column, and the second end portion having a seat mount, a vertical actuating mechanism supported by the base frame assembly and operable to drive the column to slide upward and downward relative to the base frame assembly, a horizontal actuating mechanism operable to drive the support arm to oscillate generally horizontally relative to the column, each of the horizontal actuating mechanism and the vertical actuating mechanism being electrically driven in an independent manner, and a child seat installed on the seat mount of the support arm.

DETAILED DESCRIPTION OF THE EMBODIMENTS

Figure 1:
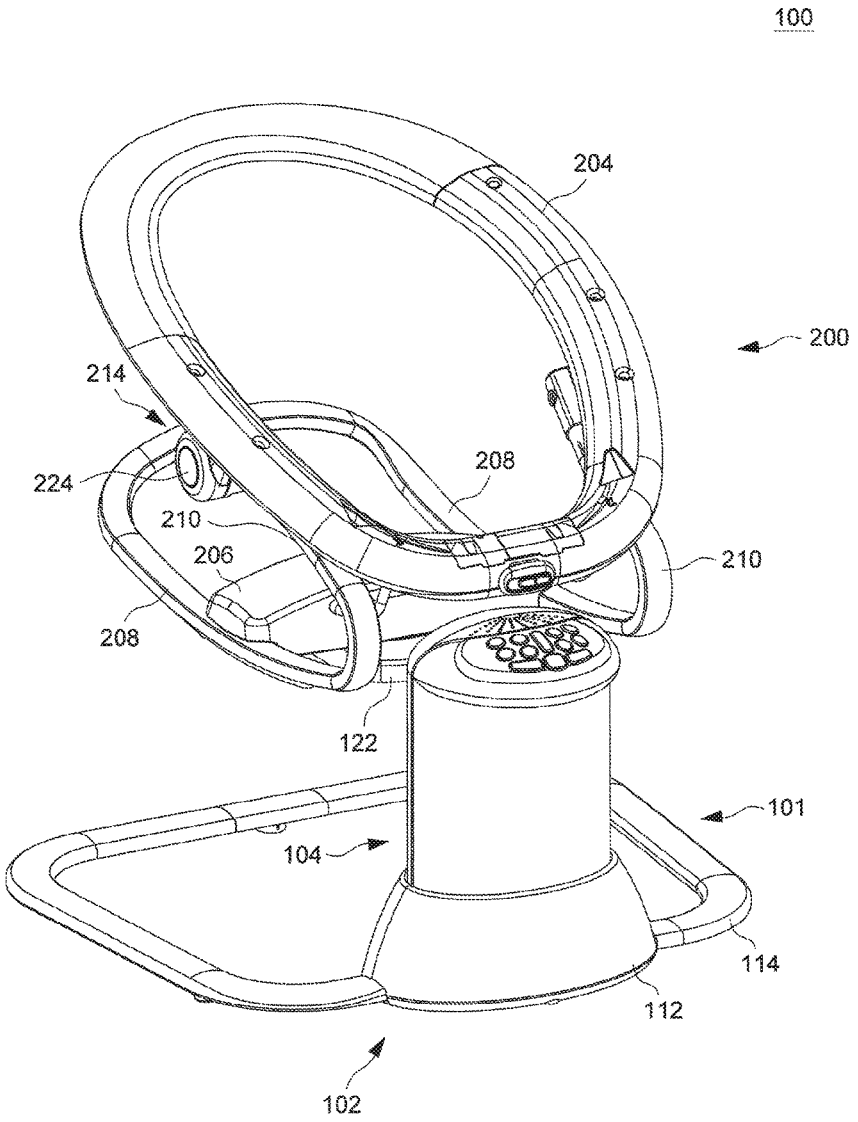
FIG. 1 is a perspective view illustrating an embodiment of a child motion apparatus.
Figure 2:
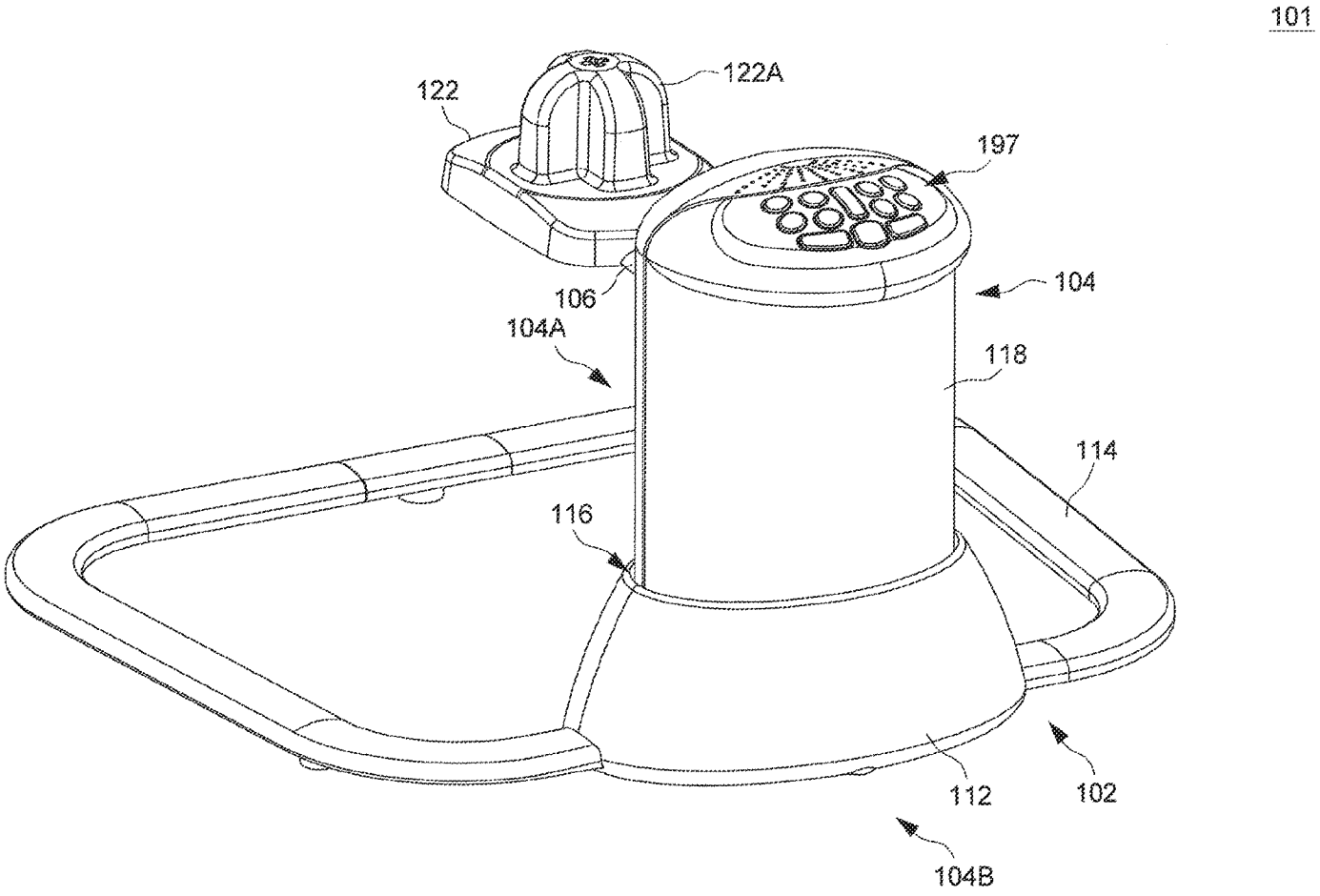
FIG. 2 is a perspective view illustrating child motion apparatus of FIG. 1 without a child seat.

FIG. 1 is a perspective view illustrating an embodiment of a child motion apparatus 100, and FIG. 2 is a perspective view illustrating a portion of the child motion apparatus 100. Referring to FIGS. 1 and 2, the child motion apparatus 100 includes a motion drive unit 101 and a child seat 200. The motion drive unit 101 includes a base frame assembly 102, a column 104 and a support arm 106. The motion drive unit 101 can stand on a floor surface, and the child seat 200 adapted to receive a child can be detachably installed on the support arm 106. The motion drive unit 101 is electrically powered to drive movement of the support arm 106 and the child seat 200 installed thereon for soothing or entertaining a child received in the child seat 200.

Figure 3:
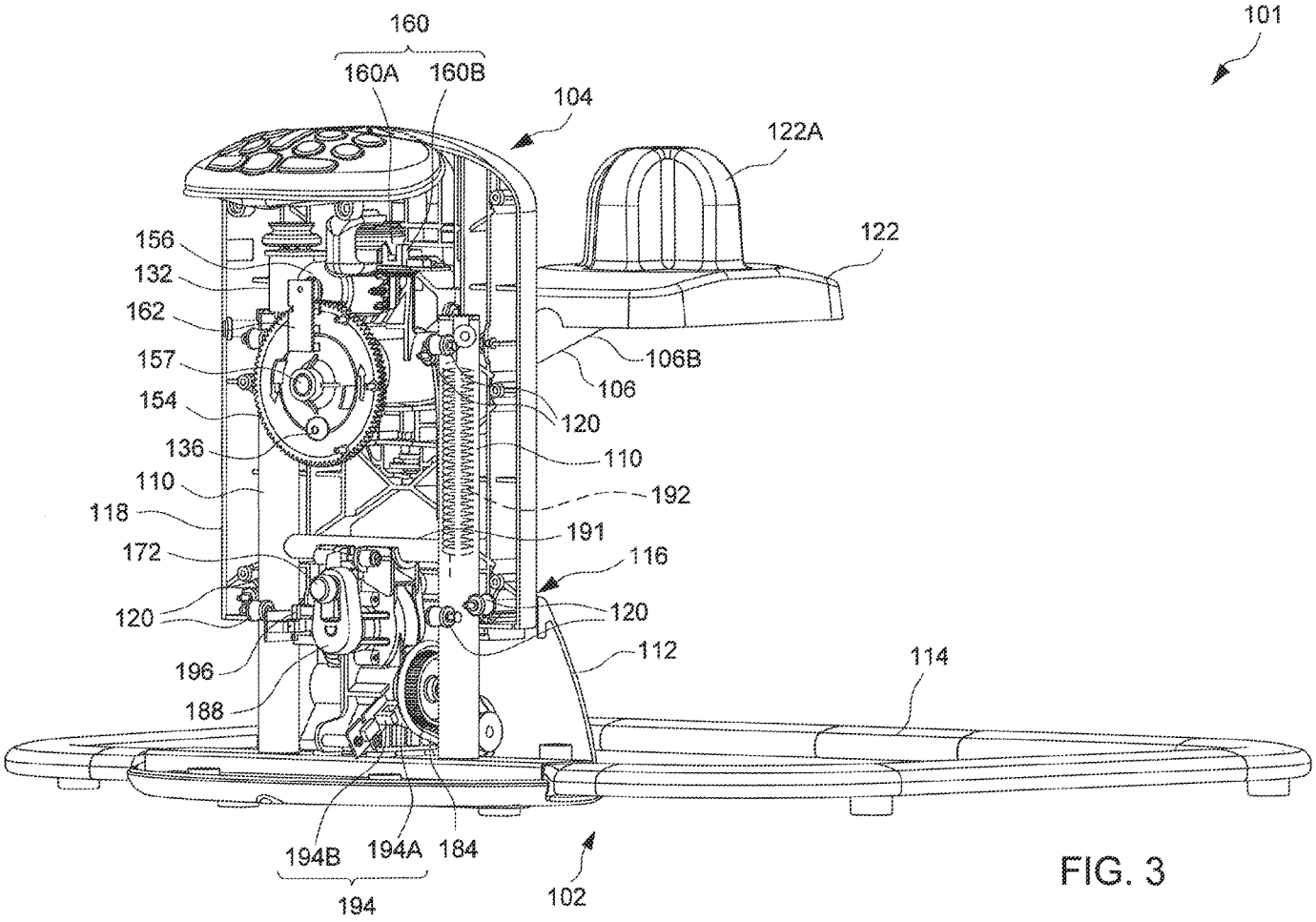
FIG. 3 is a schematic view illustrating an inner construction of a motion drive unit in the child motion apparatus shown in FIG. 1.
Figure 4:
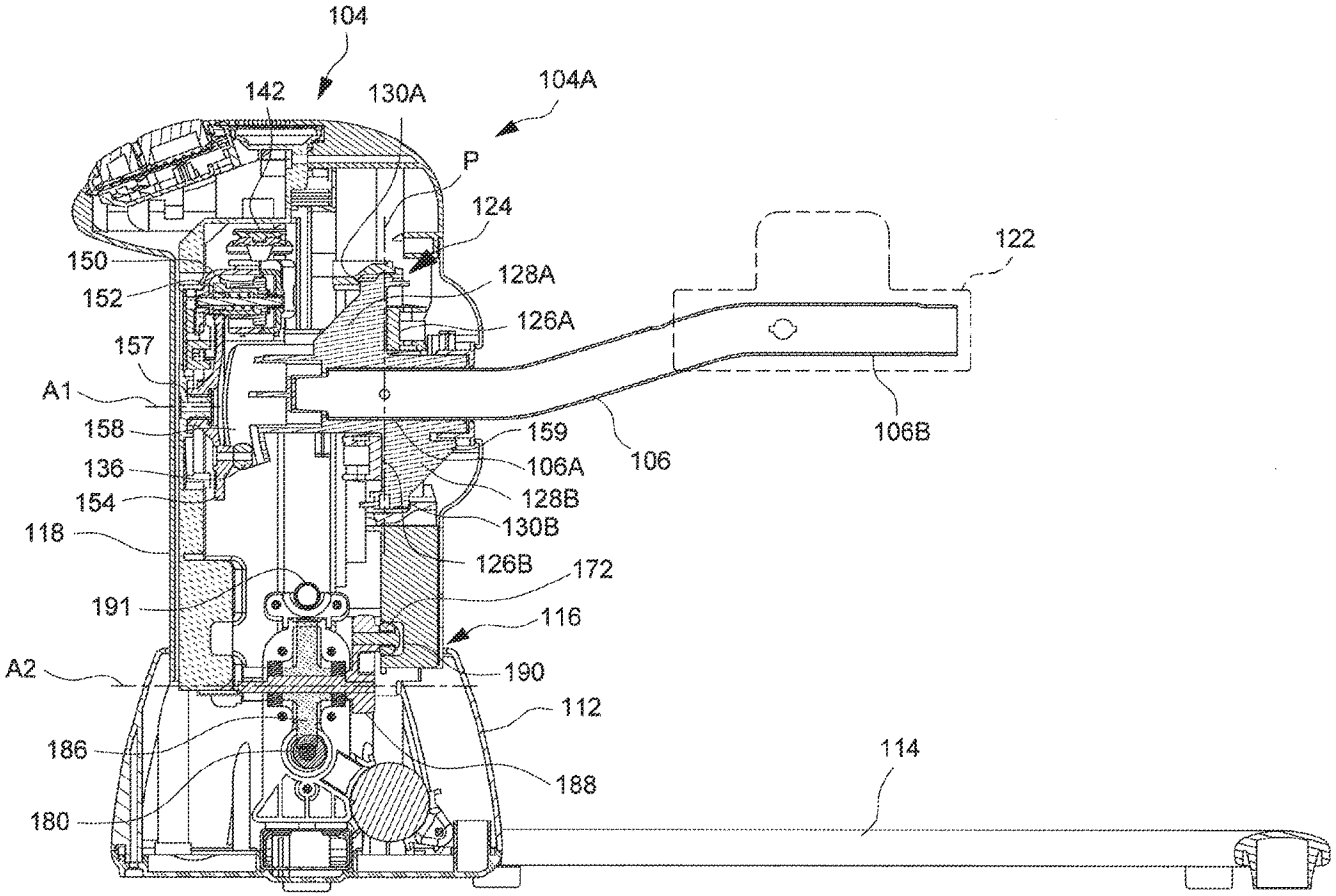
FIG. 4 is a cross-sectional view illustrating the inner construction of the motion drive unit.
Figure 5:
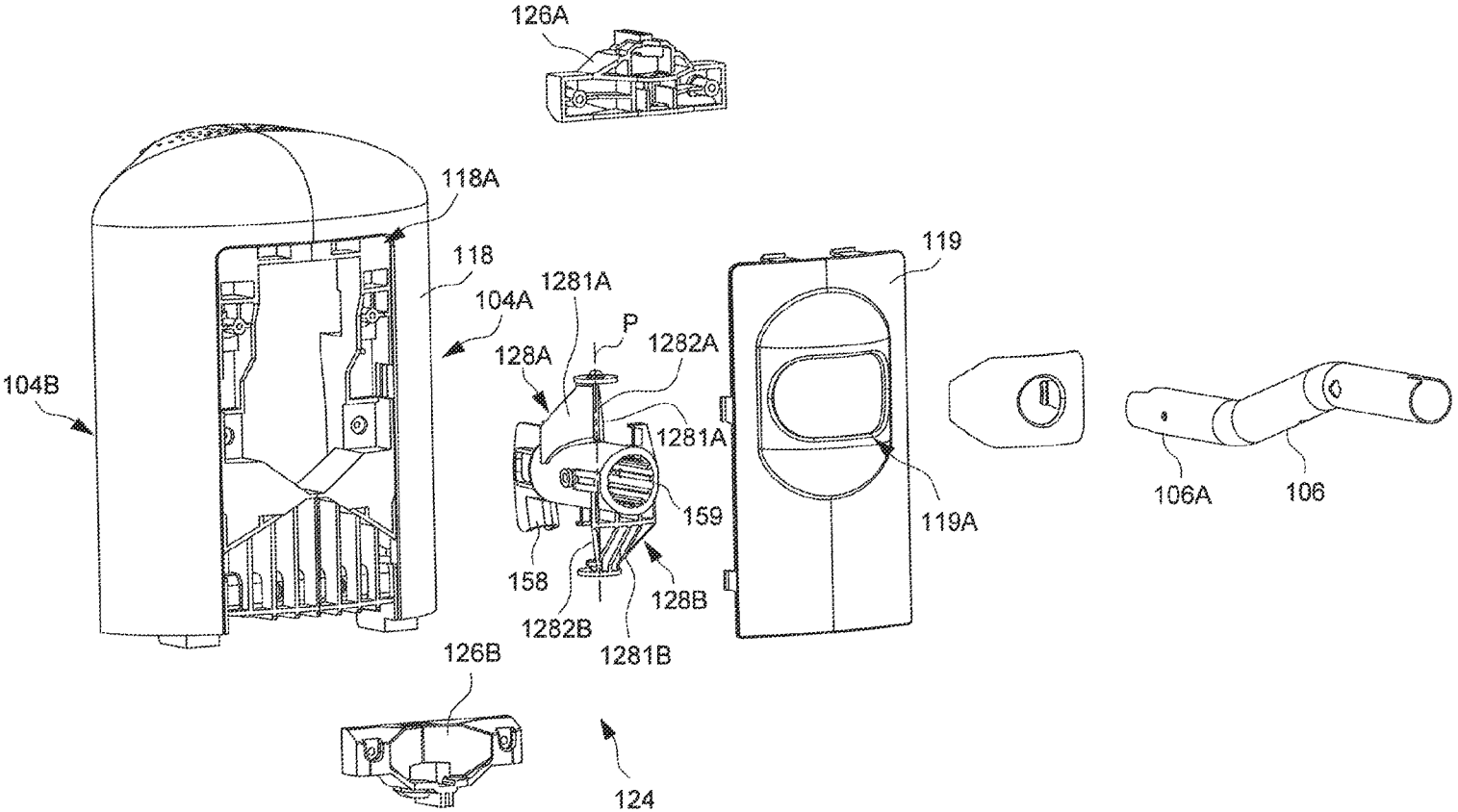
FIG. 5 is a schematic view illustrating the connection of a support arm with a column in the child motion apparatus.

In conjunction with FIGS. 1 and 2, FIG. 3 a a schematic view illustrating an inner construction of the motion drive unit 101, and FIG. 4 is a cross-sectional view of the motion drive unit 101. Referring to FIGS. 1-4, the base frame assembly 102 of the motion drive unit 101 can provide standing support on a floor surface, and can be comprised of two parallel upright tubes 110, a housing 112 and one or more stabilizing foot 114. The two upright tubes 110 are spaced apart from each other, and fixedly assembled in the housing 112. The housing 112 can have an opening 116, and the two upright tubes 110 can extend upward outside the housing 112 through the opening 116. The column 104 can be assembled with the base frame assembly 102 for vertical sliding movement through the opening 116 and along the upright tubes 110.

The stabilizing foot 114 can be formed by the assembly of one or more tubular segment, and can be detachably connected with the housing 112 at a front 104A of the column 104. In one embodiment, a stabilizing foot 114 may be provided having a closed shape and extending at the front 104A of the column 104. During use, the stabilizing foot 114 can rest in contact with a floor surface to provide a stable support for the child motion apparatus 100. When the child motion apparatus 100 is not used, the stabilizing foot 114 may be removed for facilitating storage of the motion drive unit 101.

It will be appreciated that the stabilizing foot 114 is not limited in shape and number. For example, other embodiments may provide two stabilizing feet that form a generally U-shape or V-shape extending at two sides of the housing 112 toward the front 104A of the column 104.

Referring again to FIGS. 1-4, the column 104 is assembled with the base frame assembly 102 for generally vertical sliding movement. The column 104 can include a casing 118 assembled through the opening 116 of the housing 112, the two upright tubes 110 of the base frame assembly 102 being received in the interior of the casing 118. The casing 118 of the column 104 can be assembled with rollers 120 in rolling contact with the upright tubes 110 for facilitating vertical sliding of the column 104 relative to the base frame assembly 102. The rollers 120 may further be placed around each of the upright tubes 110 to prevent rotation of the column 104 relative to the base frame assembly 102.

The support arm 106 is disposed at the front 104A of the column 104, and extends generally horizontally from the column 104 for supporting the child seat 200 in a cantilevered way above a floor surface. An end portion 106A of the support arm 106 is disposed in the column 104, and another opposite end portion 106B of the support arm 106 is affixed with a seat mount 122 on which the child seat 200 can be detachably installed.

In conjunction with FIGS. 3 and 4, FIGS. 5-7 are schematic views illustrating the connection of the support arm 106 with the column 104. Referring to FIGS. 3-7, the support arm 106 is connected with the casing 118 of the column 104 via a hinge 124 that allows generally horizontal rotation of the support arm 106 relative to the column 104. In one embodiment, the hinge 124 can include two spaced-apart pockets 126A and 126B provided in the casing 118 of the column 104, and a coupling member 159 affixed with the support arm 106 near its end portion 106A. Each of the two pockets 126A and 126B can have a V-shape, and can be affixed in the casing 118. The two pockets 126A and 126B can be respectively disposed at an upper and a lower position relative to the support arm 106 and can be oriented in opposite directions: the pocket 126A can face rearward (i.e., facing the rear 104B of the column 104), and the pocket 126B can face forward (i.e., facing the front 104A of the column 104). The coupling member 159 has two converging portions 128A and 128B respectively located at an upper and a lower side of the support arm 106. The converging portion 128A can include two surfaces 1281A that converge and join with each other along a vertical edge 1282A of the converging portion 128A, the converging portion 128B can include two surfaces 1281B that converge and join with each other along a vertical edge 1282B of the converging portion 128B, and the two vertical edge 1282A of the converging portion 128A and the vertical edge 1282B of the converging portion 128B can extend substantially along a same line. Moreover, the two converging portions 128A and 128B are oriented in opposite directions, and are respectively in sliding contact with the pockets 126A and 126B. The respective contacts between the two converging portions 128A and 128B and the two pockets 126A and 126B are substantially aligned with each other along a vertical axis, and define a pivot axis P (better shown in FIGS. 4-6) about which the support arm 106 can rotate relative to the column 104. Abutments 130A and 130B can be further provided to restrictedly position the converging portions 128A and 128B and keep their respective connections with the pockets 126A and 126B. This construction forms a hinge allowing a horizontal swing motion of the support arm 106 about the pivot axis P relative to the column 104. For facilitating the assembly of the column 104, the casing 118 can have a front opening 118A, and a panel assembly 119 having an opening window 119A for passage of the support arm 106 can be engaged with the casing 118 to close the front opening 118A to retain the coupling member 159 inside the column 104.

Figure 8:
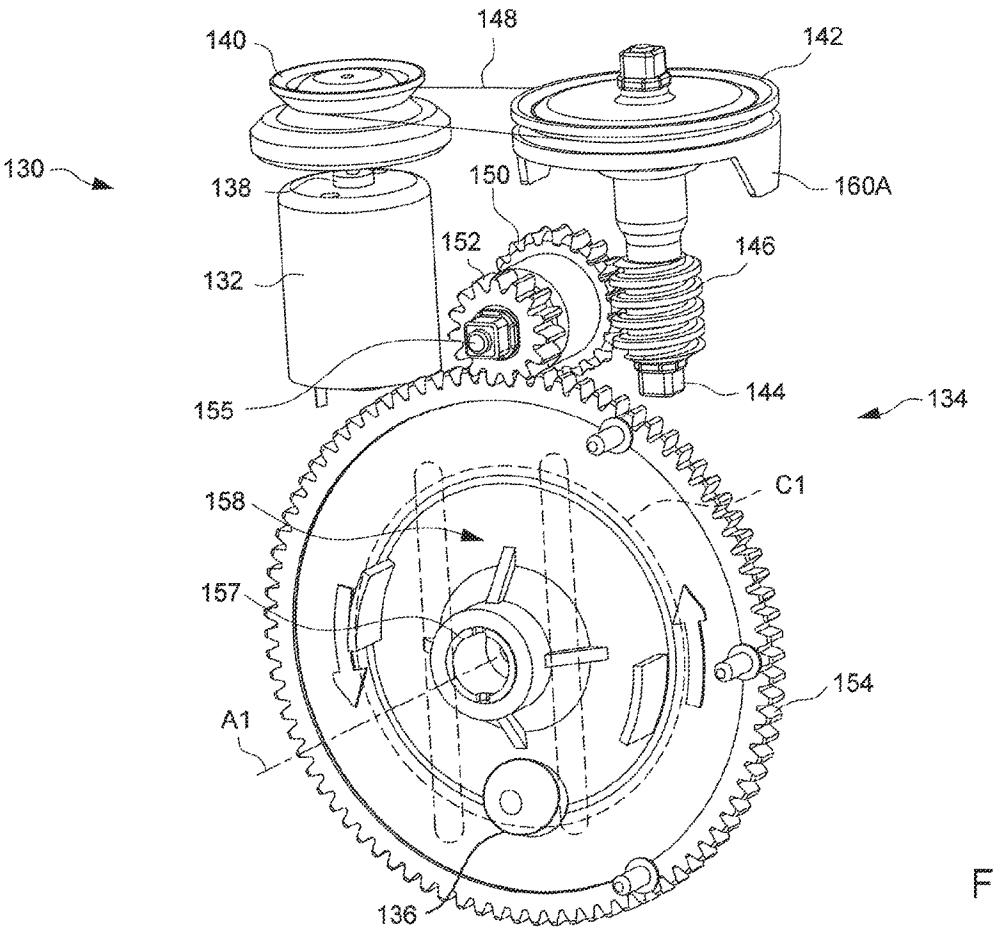
FIG. 8 is a schematic view illustrating the construction of a horizontal actuating mechanism operable to drive the support arm to oscillate generally horizontally relative to the column in the child motion apparatus.

In conjunction with FIGS. 3 and 4, FIG. 8 is a schematic view illustrating the construction of a horizontal actuating mechanism 130 operable to drive the support arm 106 to oscillate generally horizontally relative to the column 104. Referring to FIGS. 3, 4 and 8, the horizontal actuating mechanism 130 is disposed in the casing 118 of the column 104, and can include an electric motor 132, a transmission assembly 134 and a driving part 136. The electric motor 132 can be a DC motor, and can have an output shaft 138 extending along a generally vertical direction.

The transmission assembly 134 is respectively coupled with the output shaft 138 of the electric motor 132 and the driving part 136. In one embodiment, the transmission assembly 134 can include two pulleys 140 and 142, a worm shaft 144 affixed with a worm 146, a belt 148, a worm gear 150 and two gears 152 and 154. The pulley 140 is affixed with the output shaft 138 of the electric motor 132, the pulley 142 is affixed with the worm shaft 144, and the belt 148 is connected with the two pulleys 140 and 142, whereby rotation of the motor output shaft 138 can be transmitted to the worm shaft 144. The worm gear 150 and the gear 152 are rotationally coupled with each other and are coaxially assembled about a worm gear shaft 155 extending generally horizontally, the worm gear 150 meshing with the worm 146, and the gear 152 meshing with the gear 154. The electric motor 132, the worm shaft 144, the worm gear shaft 155 and the gear 152 can be assembled with a housing 156 (better shown in FIG. 3), which forms a unitary block attached to the casing 118 of the column 104. The gear 154 is connected with a shaft 157 that is spaced apart from the housing 156 and is assembled with the casing 118 of the column 104. The gear 154 is rotatable about an axis A1 extending generally horizontally, and has a diameter that is greater than the diameter of the gear 152. The driving part 136 is attached to the gear 154, so that rotation of the gear 154 about the axis A1 can cause the driving part 136 to move along a circular path C1 centered on the axis A1 in a generally vertical plane.

Figure 6:
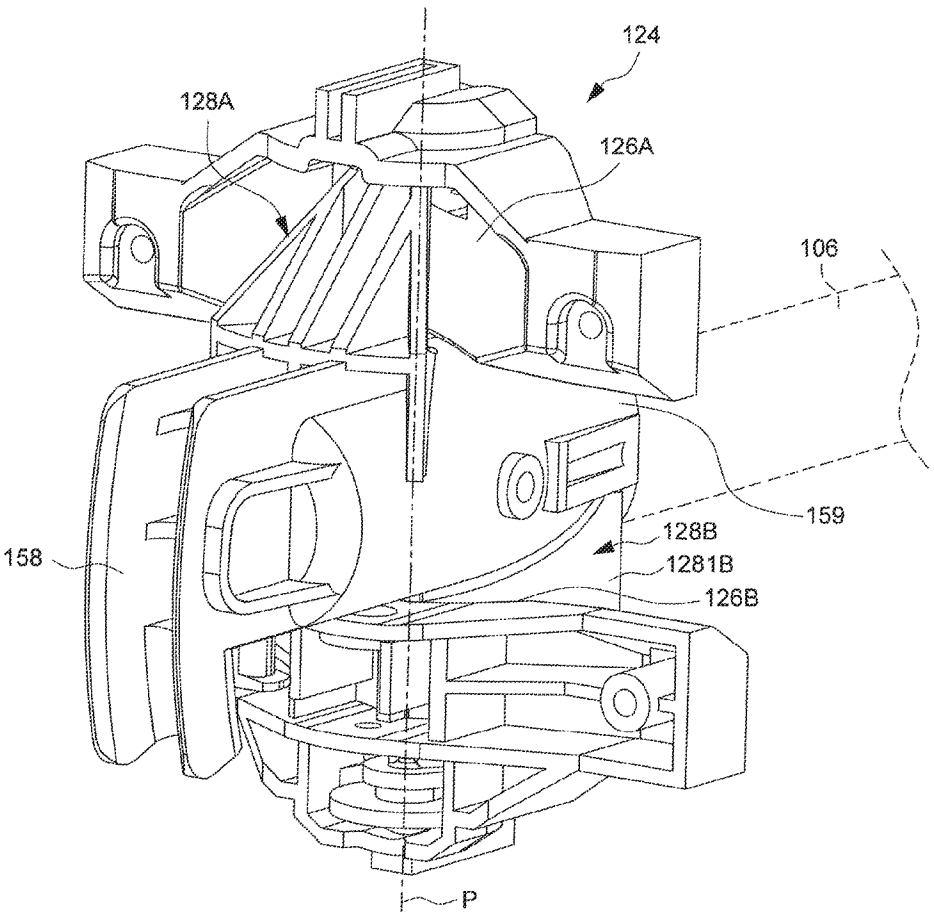
FIG. 6 is a schematic view illustrating the assembly of a hinge for connecting the support arm with the column.
Figure 7:
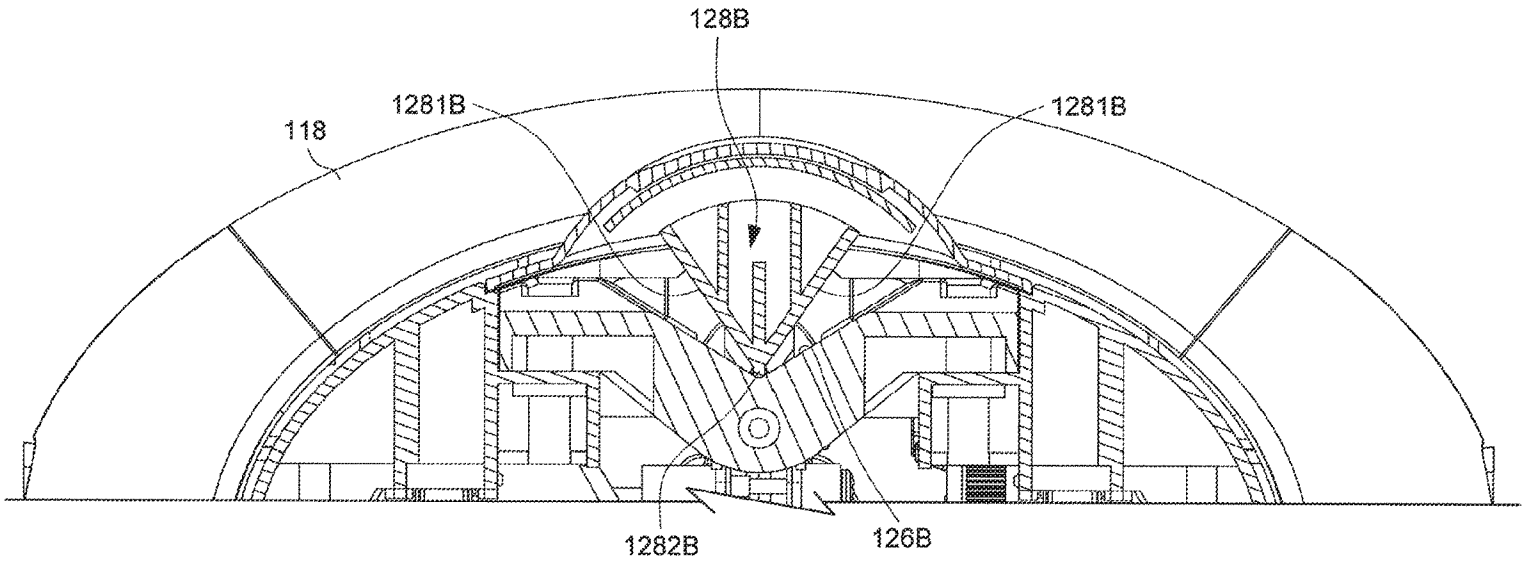
FIG. 7 is a schematic cross-sectional view illustrating a portion of the hinge for connecting the support arm with the column.

Referring again to FIGS. 3-6 and 8, the driving part 136 can be a roller or a ball bearing. The driving part 136 can be guided for sliding movement along a channel 158 (better shown in FIGS. 4 and 6) provided at the end portion 106A of the support arm 106. In one embodiment, the channel 158 can be exemplary formed integrally with the coupling part 159 affixed to the support arm 106 at the end portion 106A, as shown in FIGS. 4 and 6. The channel 158 extends generally vertically, and has a length that encompasses a diameter of the circular path C1. In other words, the length of the channel 158 is not less than the diameter of the circular path C1. With this construction, a continuous circular motion of the driving part 136 can drive generally horizontal oscillating movement of the support arm 106 about the hinge 124 relative to the column 104, which can displace the child seat 200 along a curved path around the column 104.

Referring to FIGS. 3 and 8, the horizontal actuating mechanism 130 may further include a plurality of detectors for acquiring data that can facilitate motion control of the support arm 106 and child seat 200. For example, a detector 160 (better shown in FIG. 3) including an encoder wheel 160A affixed to the worm shaft 144 and an optical sensor 160B can measure an angular position of the worm shaft 144 from which an angular position of the driving part 136 can be determined at any given time. Another detector 162 may be used to detect when the driving part 136 reaches or travels past a reference position, which may exemplary correspond to a central position of the support arm 106 relative to the column 104. A microcontroller (not shown) may use the aforementioned data to desirably control the swing motion of the support arm 106.

Figure 9:
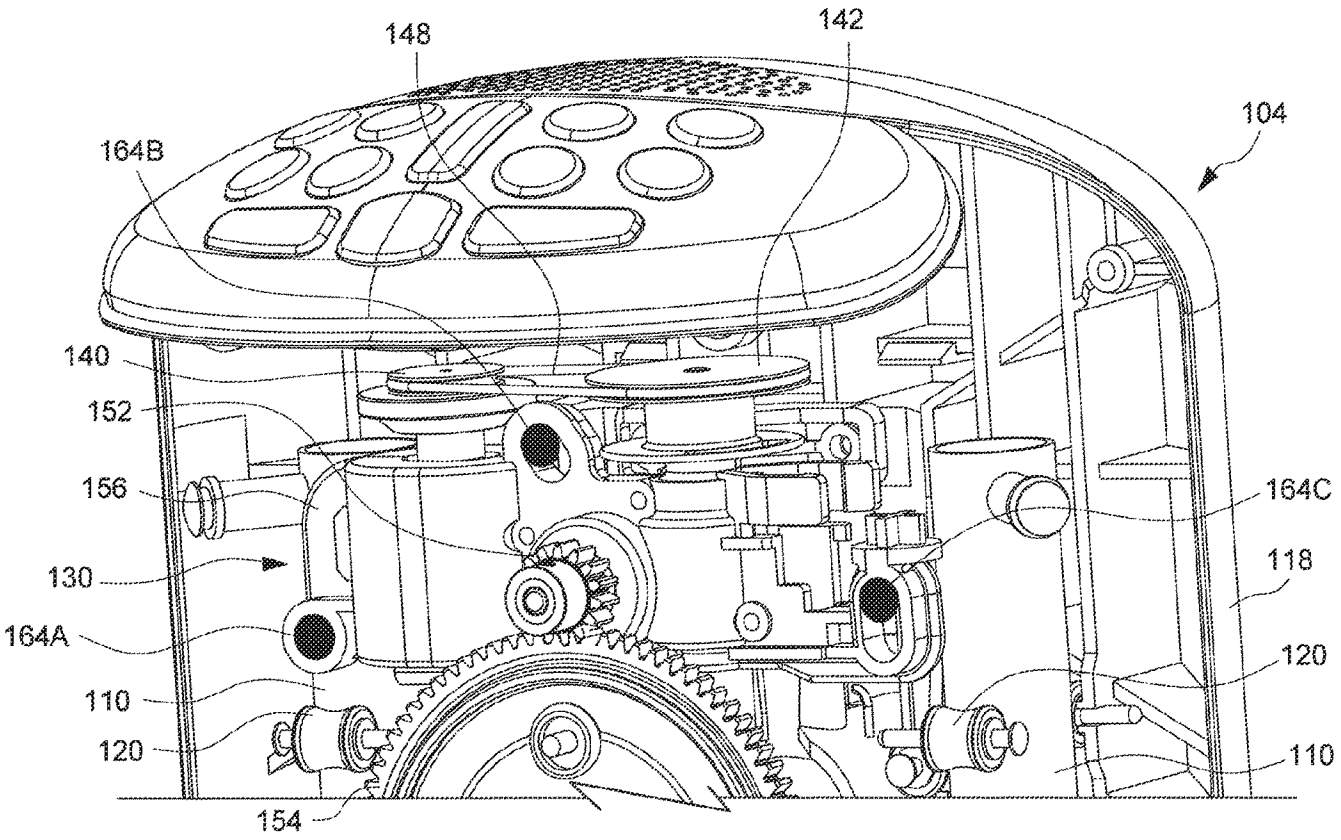
FIG. 9 is a schematic view illustrating a protection mechanism for the horizontal actuating mechanism.
Figure 10:
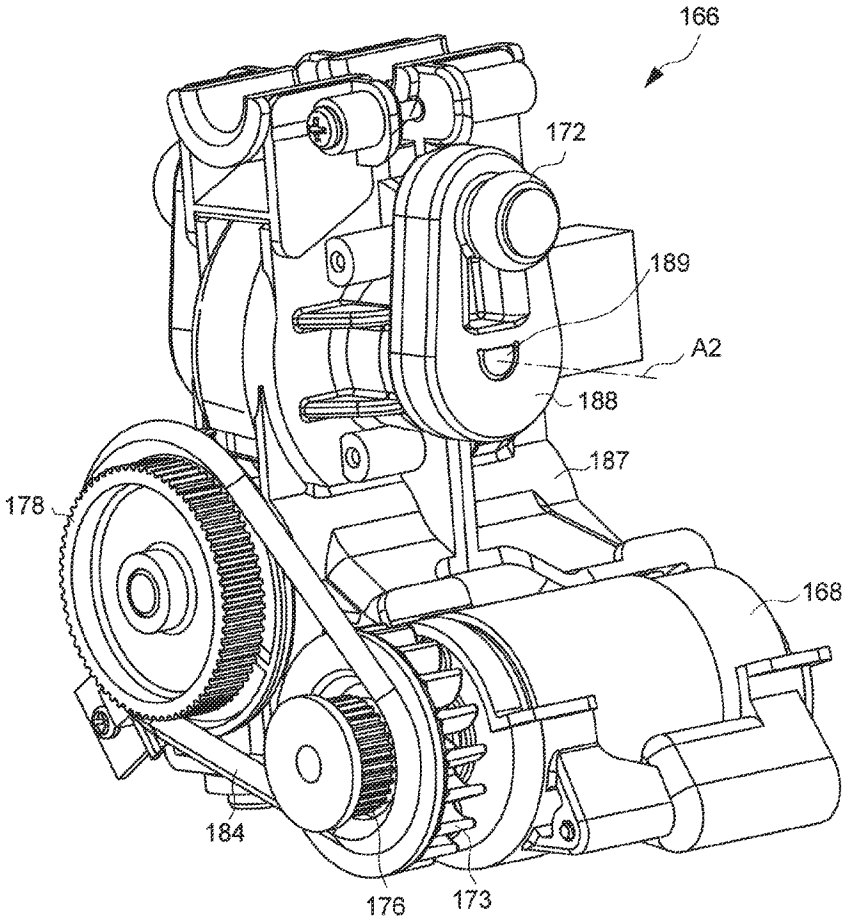
FIGS. 10 and 11 are schematic views illustrating a vertical actuating mechanism operable to drive the column of the child motion apparatus to slide upward and downward.

In some embodiment, a protection mechanism may further be provided to prevent the horizontal actuating mechanism 130 from being damaged in the event that the child seat 200 is inadvertently stopped or pushed while the support arm 106 is driven in movement by the horizontal actuating mechanism 130. FIG. 9 is a schematic view illustrating an example of this protection mechanism embodied in an attachment of the housing 156 to the casing 118 that allows a limited rotation of the housing 156 relative to the casing 118 sufficient to disengage the gear 152 from the gear 154. For example, a plurality of screws 164A, 164B and 164C may be used to restrictedly position the housing 156 in the casing 118, the housing 156 being allowed to pivot about one of the screws, e.g., screw 164A. A spring (not shown) may be provided to bias the housing 156 downward so that the gears 152 and 154 are meshed with each other under normal operating conditions.

In conjunction with FIGS. 3 and 4, FIGS. 10 and 11 are schematic views illustrating a vertical actuating mechanism 166 operable to drive the column 104 to slide upward and downward relative to the base frame assembly 102. The vertical actuating mechanism 166 is operable independently from the horizontal actuating mechanism 130. Referring to FIGS. 3, 4, 10 and 11, the vertical actuating mechanism 166 is supported by the base frame assembly 102, and can include an electric motor 168, a transmission assembly 170 (better shown in FIG. 11) and a driving part 172. The electric motor 168 can be a DC motor, and can have an output shaft 174 extending along a generally horizontal direction. In some embodiments, a fan 173 may be optionally coupled with the output shaft 174 for promoting cooling of the electric motor 168. The vertical actuating mechanism 166 as described herein can be assembled with a housing 187 that is fastened to at least a horizontal cross tube 191 which are welded to the two upright tubes 110. The representation of the housing 187 is omitted in FIG. 11 for better showing the construction of the transmission assembly 170.

The transmission assembly 170 is respectively coupled with the output shaft 174 of the electric motor 168 and the driving part 172. In one embodiment, the transmission assembly 170 can include two pulleys 176 and 178, a worm shaft 180 affixed with a worm 182, a belt 184, a worm gear 186 and a crank 188. The pulley 176 is affixed with the output shaft 174 of the electric motor 168, the pulley 178 is affixed with the worm shaft 180, and the belt 184 is connected with the two pulleys 176 and 178, whereby rotation of the motor output shaft 174 can be transmitted to the worm shaft 180. Moreover, the worm gear 186 and the crank 188 are coaxially affixed with a worm gear shaft 189 extending generally horizontally, the worm gear 186 meshes with the worm 182, and the driving part 172 is attached to the crank 188. The worm gear 186 and the crank 188 are thereby rotationally coupled with each other about an axis A2 extending generally horizontally, and rotation of the crank 188 about the axis A2 can cause the driving part 172 to move along a circular path C2 centered on the axis A2 in a generally vertical plane.

Referring again to FIGS. 3, 4 and 10, the driving part 172 can be a roller or a ball bearing. The driving part 172 can be guided for sliding movement along a channel 190 provided in the column 104. In one embodiment, the channel 190 can be exemplary affixed to the casing 118 of the column 104 at a location below the channel 158 of the support arm 106. The channel 190 extends generally horizontally, and has a length that encompasses a diameter of the circular path C2. With this construction, a continuous circular motion of the driving part 172 can drive generally vertical movement of the column 104 (along with the support arm 106, the child seat 200 and the horizontal actuating mechanism 130 assembled with the column 104) relative to the base frame assembly 102.

Referring to FIG. 3, a counterbalance spring mechanism may further be provided to assist in sustaining the weight of the column 104, support arm 106 and child seat 200. The counterbalance spring mechanism can include two extension springs 192 (shown with phantom lines) respectively disposed along the two upright tubes 110. Each extension spring 192 can have an upper end anchored with one upright tube 110, and a lower end anchored with a bottom of the casing 118 of the column 104. The extension springs 192 can apply an upward biasing force that pulls up against gravity to assist the vertical actuating mechanism 166 in lifting the weight of the supported load (i.e., including the column 104, support arm 106, child seat 200 and occupant in the child seat 200), and to balance uneven force applied on the column 104 side to side.

Figure 11:
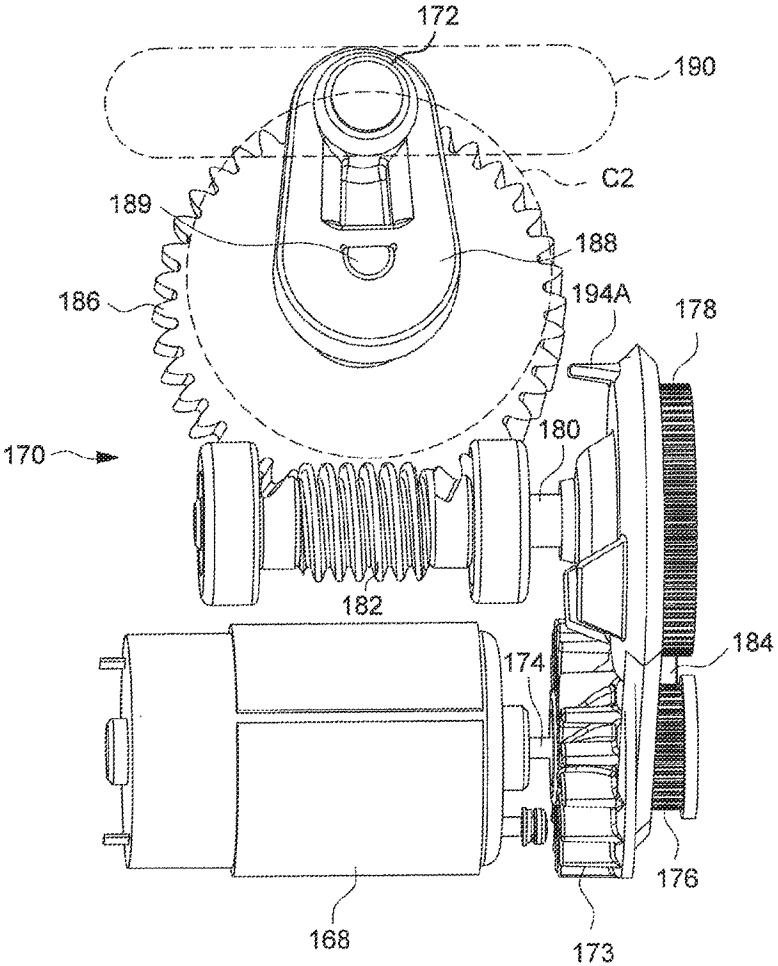

Referring to FIGS. 3 and 11, the vertical actuating mechanism 166 may further include a plurality of detectors for acquiring data that can facilitate motion control of the column 104. For example, a detector 194 including an encoder wheel 194A affixed to the worm shaft 180 and an optical sensor 194B can be used to determine an angular position and rotational speed of the worm shaft 180. Another detector 196 may be used to detect when the driving part 172 reaches or travels past a reference position. The microcontroller (not shown) of the child motion apparatus may use the aforementioned data to desirably control the vertical motion of the column 104.

The horizontal actuating mechanism 130 and the vertical actuating mechanism 166 as described herein have similar construction, and can be assembled in a compact space, their respective driving parts 136 and 172 moving in two generally vertical planes that are parallel or substantially parallel to each other. During operation, each of the horizontal actuating mechanism 130 and the vertical actuating mechanism 166 can be electrically driven in an independent manner, so that the horizontal actuating mechanism 130 and the vertical actuating mechanism 166 can operate individually or together to move the child seat 200 in a variety of motions for soothing or entertaining a child. As shown in FIG. 2, a control interface 197 comprised of buttons and/or keys may be provided at a top of the column 104 for manual setting of different functions of the child motion apparatus 100. For example, the control interface 197 can include buttons and/or keys for starting and stopping a motion, setting a desired type of motion, setting a speed of the motion, and the like. The control interface 197 may be easily accessible for operation at the rear 104B of the column 104.

The horizontal actuating mechanism 130 and the vertical actuating mechanism 166 described herein use separate electric motors to respectively drive and maintain horizontal and vertical motions. It will be understood, however, that other means may be employed to drive and/or maintain the horizontal and vertical motions in an independent manner. For example, each of the horizontal actuating mechanism and the vertical actuating mechanism can also be electrically driven in an independent manner by using separate electromagnetic devices rather electric motors. Exemplary electromagnetic devices can include two electromagnets interacting with each other, or an electromagnet interacting with a permanent magnet. The electromagnetic devices can generate electromagnetic forces to drive and/or maintain the horizontal and vertical motions.

Referring again to FIG. 2, the seat mount 122 affixed at the end portion 106B of the support arm 106 allows the installation of the child seat 200 on the support arm 106 in different orientations at the front 104A of the column 104. In one embodiment, the seat mount 122 can be formed as a unitary part having a protuberance 122A, and the child seat 200 can be affixed with a connector 212 (better shown in FIG. 13) having an opening that can mate with the protuberance 122A of the seat mount 122. The engaging shapes provided on the seat mount 122 and connector 212 are rotationally symmetrical, so that the seat mount 122 and the connector 212 can engage with each other in different orientations of the child seat 200. Examples of rotationally symmetrical shapes for the seat mount 122 and connector 212 can include, without limitation, cross shapes, star shapes, square shapes, and the like. In this manner, the child seat 200 can be installed on the support arm 106 facing the column 104 or facing away from the column 104 (i.e., the front of the child seat 200 is oriented toward or opposite to the column 104) for providing sideways motions, or facing a left or a right side of the column 104 (i.e., the front of the child seat 200 is oriented to the left or right side of the column 104) for providing back and forth motions.

Figure 12:
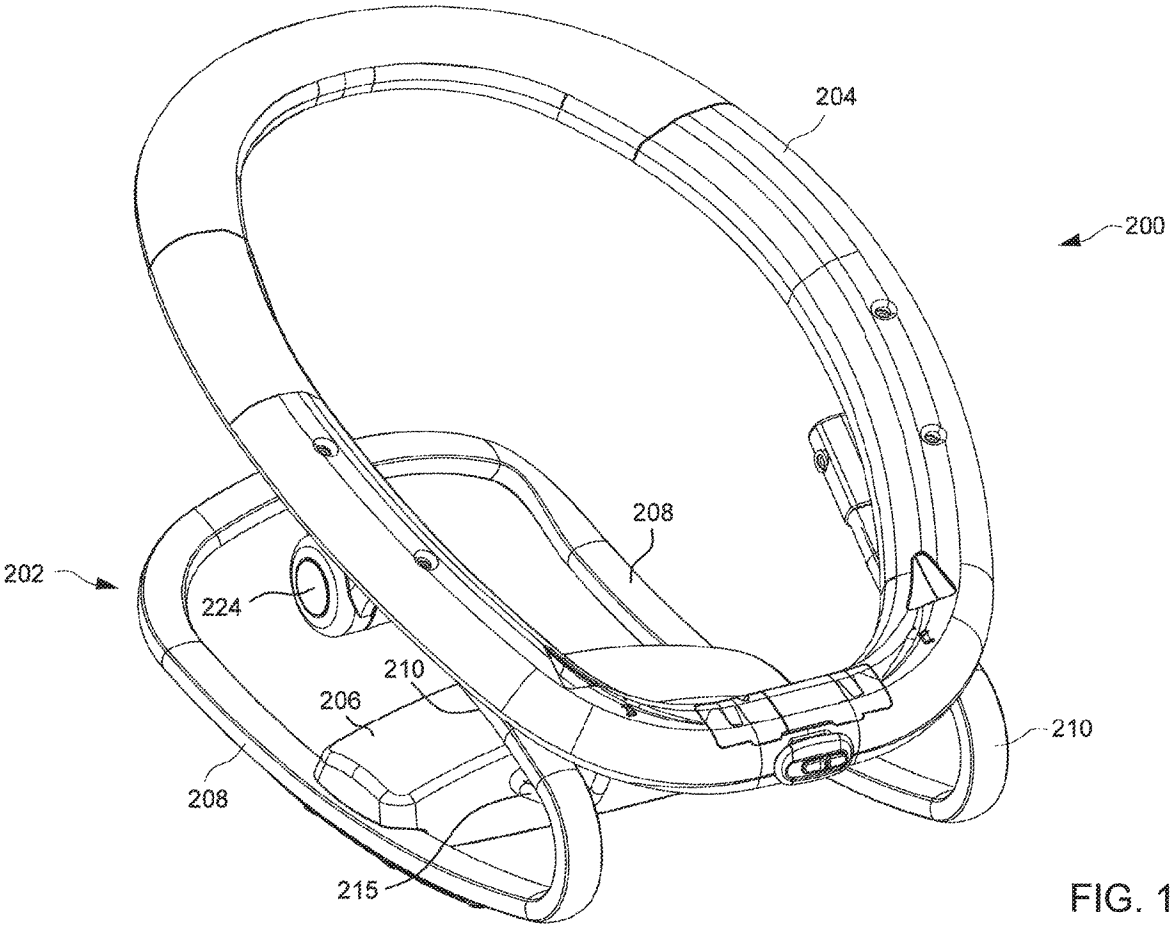
FIG. 12 is a perspective view illustrating a detachable child seat used in the motion apparatus.
Figure 13:
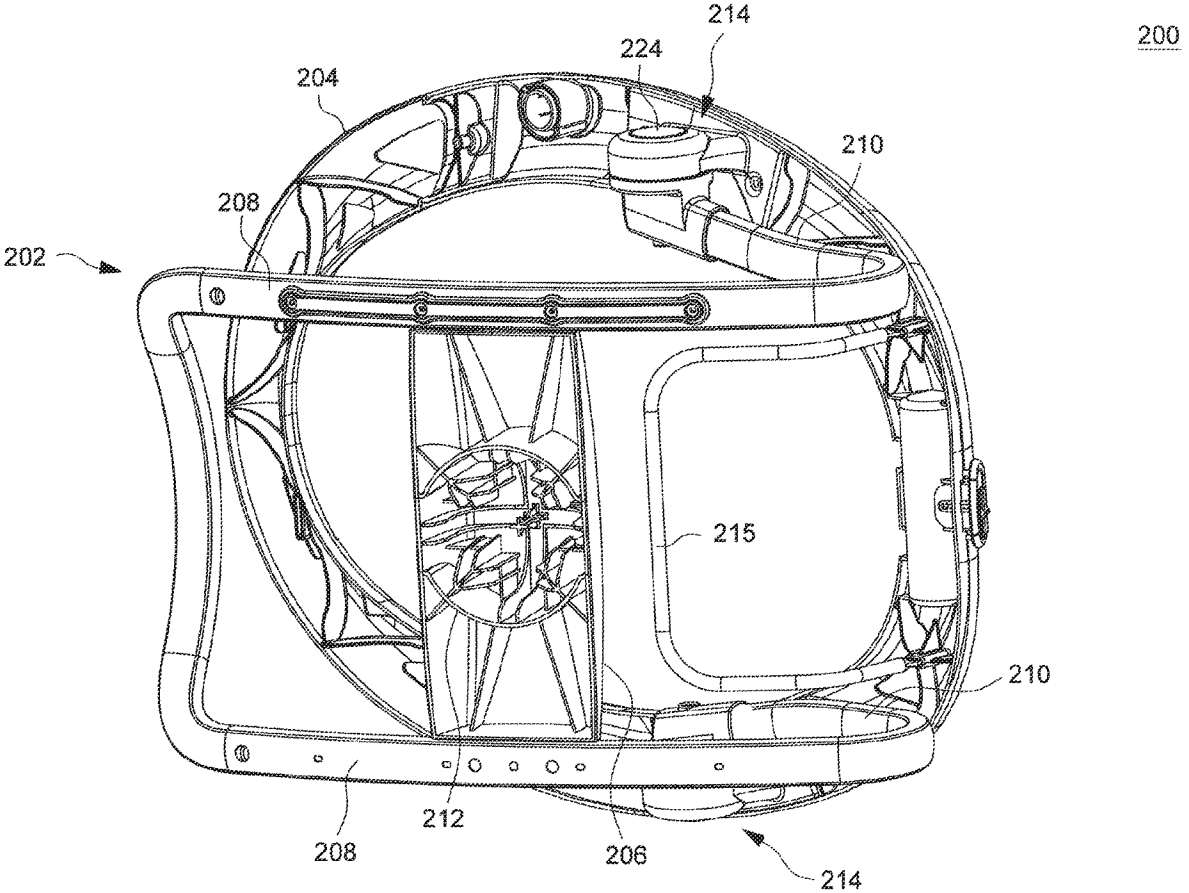
FIG. 13 is another perspective of the child seat shown in FIG. 12.

In conjunction with FIG. 1, FIGS. 12 and 13 are schematic views illustrating the child seat 200 alone. The child seat 200 can be constructed as a child rocking chair. The child seat 200 can include a support frame 202, and a surrounding frame 204 assembled above the support frame 202. The support frame 202 can include a transversal portion 206, and a foot portion 208 and a strut 210 affixed to each other that are disposed at each of a left and a right side of the child seat 200. The foot portions 208 and the struts 210 can be disposed symmetrically at a left and a right side of the child seat 200. Each foot portion 208 can have a curved shape, and the strut 210 affixed thereto can rise upward. The two foot portions 208 can provide independent support for the child seat 200 when it is removed from the support arm 106 and used as a standalone seat. Moreover, the curved shape of the foot portions 208 allows the child seat 200 to rock on a support surface (e.g., floor surface), so that the child seat 200 can be used as a standalone rocking chair with the foot portions 208 in contact with the support surface.

The transversal portion 206 can extend across a central region of the child seat 200 between the two foot portions 208, and can be respectively affixed with the two foot portions 208 at the left and right side. An underside of the transversal portion 206 is affixed with the connector 212 that can engage with the seat mount 122 for restrictedly positioning the child seat 200 on the support arm 106. The connector 212 can be exemplary placed at a middle position between the two foot portions 208.

The surrounding frame 204 has a closed shape, and can provide support for attachment of a soft material (e.g., fabric) forming a support seat for a child. The surrounding frame 204 has a left and a right side respectively connected pivotally with the two struts 210 via two pivot joints 214, which allow the surrounding frame 204 to rotate relative to the support frame 202 for recline adjustment. Moreover, a lower bar 215 may further be connected with the surrounding frame 204 near its front to provide additional support for the soft material.

Figure 14:
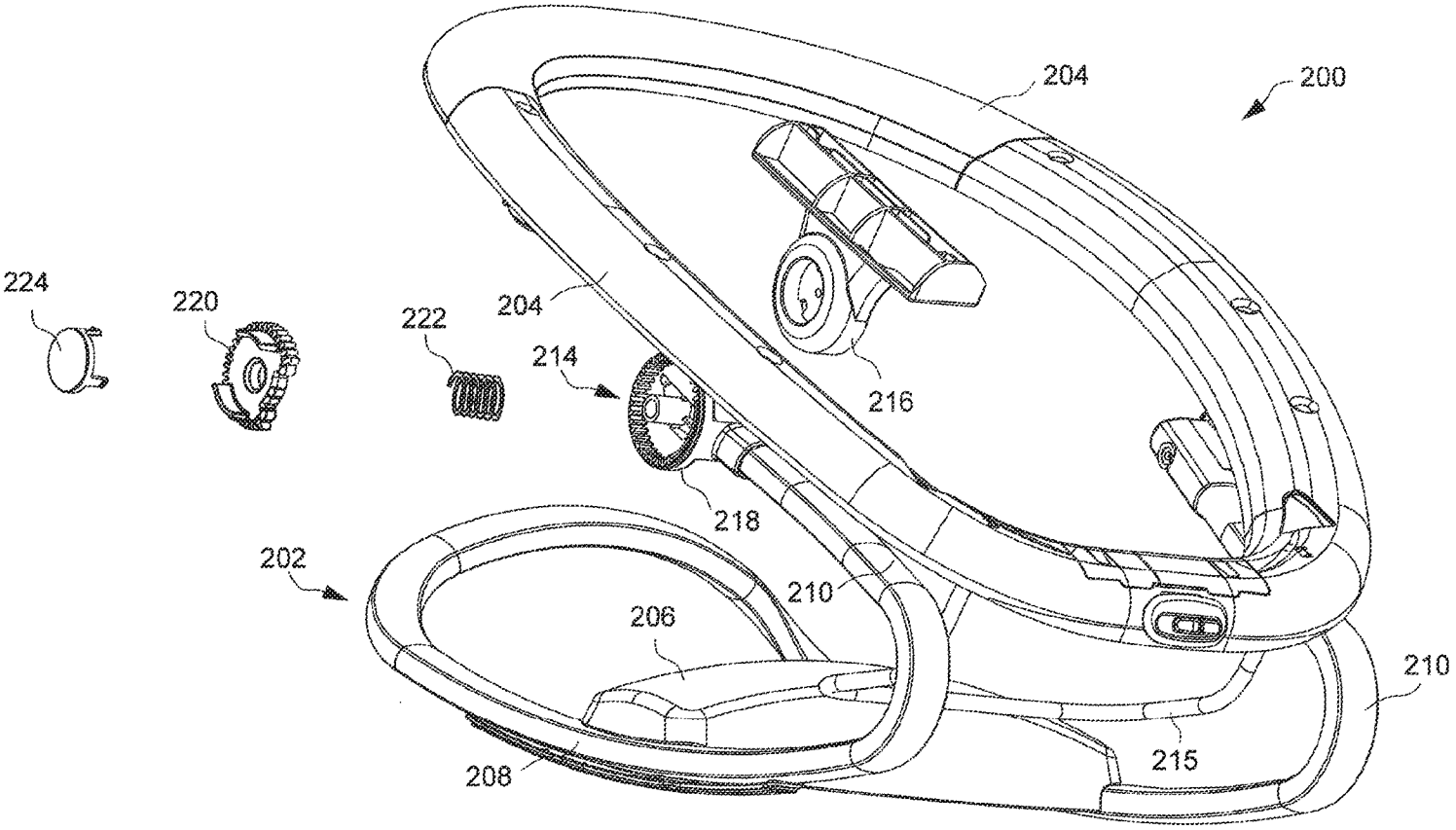
FIG. 14 is a schematic view illustrating the construction of a pivot joint connecting a surrounding frame with a support frame in the child seat shown in FIG. 12.

Referring to FIG. 14, each pivot joint 214 can include a coupling shell 216 affixed with the surrounding frame 204, and another coupling shell 218 affixed with one strut 210 and pivotally connected with the coupling shell 216. The two coupling shells 216 and 218 can define a hollow interior in which a latch 220 is assembled for sliding movement along the pivot axis of the surrounding frame 204 relative to support frame 202. The latch 220 can slide between a locking position where it engages with teeth provided in the two coupling shells 216 and 218 for locking the surrounding frame 204 in position, and an unlocking position where the latch 220 is disengaged from the teeth of one of the two coupling shells 216 and 218 (e.g., coupling shell 216) to allow rotation of the surrounding frame 204 for recline adjustment. A spring 222 can be assembled in the interior of the two coupling shells 216 and 218 for biasing the latch 220 toward the locking state. Moreover, a release button 224 can be assembled with the coupling shell 216, and can be depressed to push the latch 220 to the unlocking state.

The child seat 200 described herein can be used separately as a standalone rocking chair capable of rocking back and forth for soothing a child. When a different type of movement is required, the child seat 200 can be installed on the support arm 106 of the motion drive unit 101 to form the child motion apparatus 100, whereby a wide range of additional motions can be available to soothe or entertain a child received in the child seat 200.

It will be appreciated that the child seat is not limited to the aforementioned embodiment, and other constructions of the child seat may be possible as described hereinafter.

Figure 15:
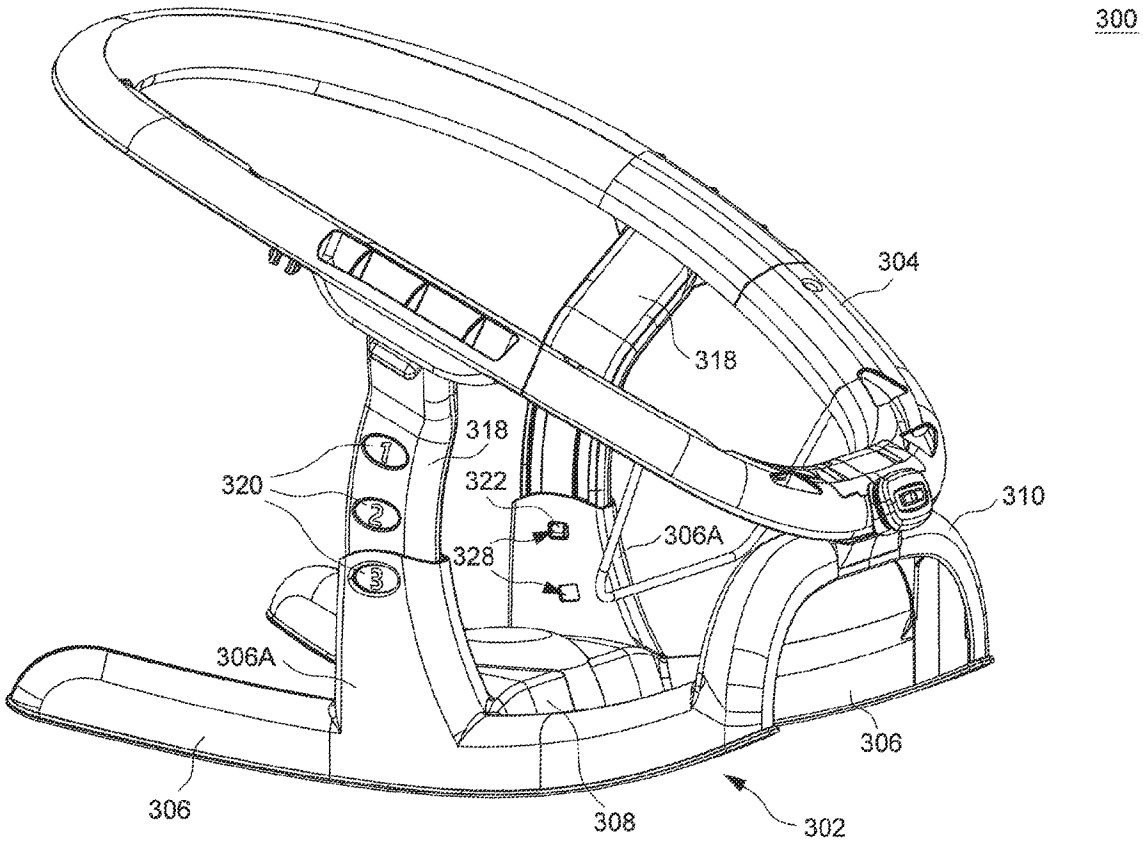
FIG. 15 is a perspective view illustrating another embodiment of a detachable child seat that can be used in the motion apparatus.
Figure 16:
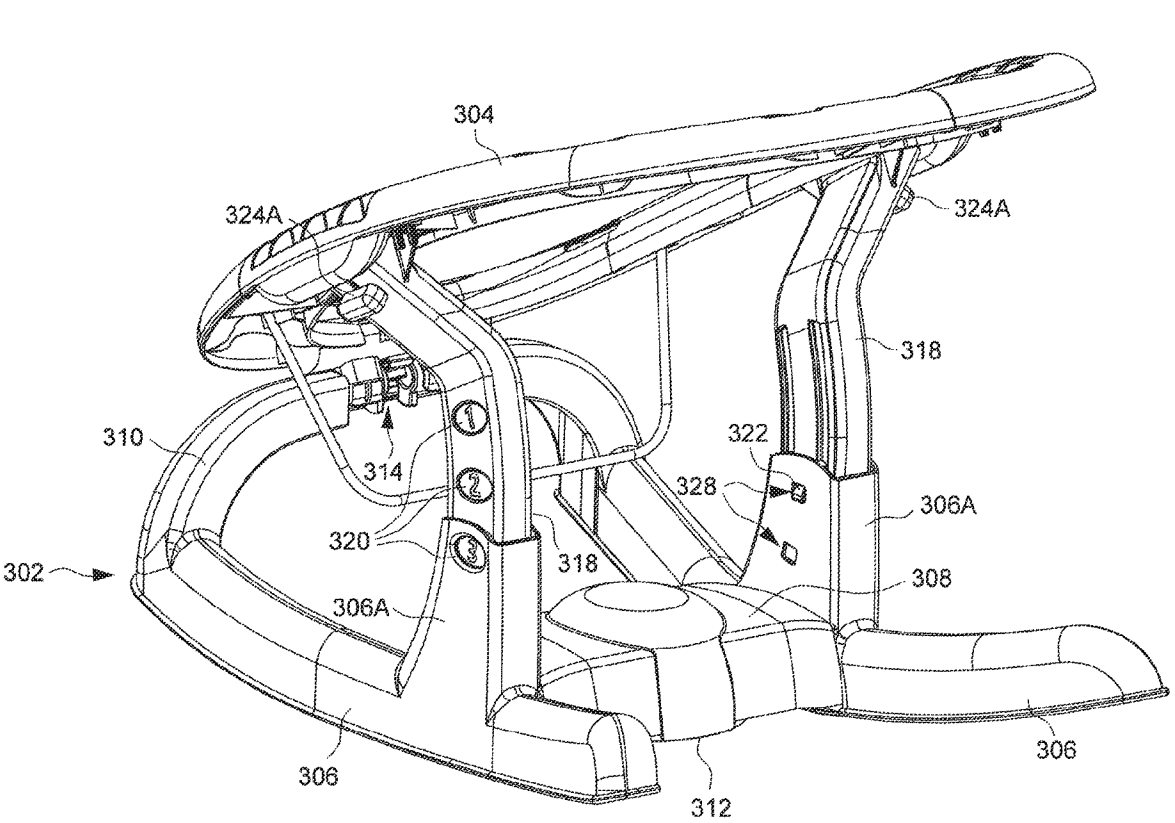
FIG. 16 is another perspective view of the child seat shown in FIG. 15.

FIGS. 15 and 16 are schematic views illustrating another embodiment of a child seat 300 that may be installed on the support arm 106. The child seat 300 can include a support frame 302, and a surrounding frame 304 assembled above the support frame 302. The support frame 302 can include two curved foot portions 306 and a transversal portion 308. The foot portions 306 can be disposed symmetrically at a left and a right side of the child seat 300, and can be connected with each other by a linking portion 310 at a front of the support frame 302. The foot portions 306 can provide independent support for the child seat 300 when it is removed from the support arm 106 and used as a standalone seat. Moreover, the curved shape of the foot portions 306 allows the child seat 300 to rock on a support surface (e.g., floor surface) so that it can be used as a standalone rocking chair.

The transversal portion 308 can extend across a central region of the child seat 300 between the two foot portions 306, and can be respectively connected with the two foot portions 306 at the left and right side Like previously described, an underside of the transversal portion 308 can be affixed with a connector 312 that can engage with the seat mount 122 for restrictedly positioning the child seat 300 on the support arm 106.

The surrounding frame 304 has a closed shape, and can provide support for attachment of a soft material (e.g., fabric) forming a support seat for a child. The surrounding frame 304 has a front portion pivotally connected with the linking segment 310 via a hinge 314, and is tilted so that a rear portion of the surrounding frame 304 is higher than the front portion of the surrounding frame 304.

Two struts 318 are respectively affixed with a left and a right side of the surrounding frame 304, and respectively connect with the foot portions 306 below the surrounding frame 304. More specifically, the two foot portions 306 can respectively have sleeves 306A protruding upward, and the struts 318 can be telescopically assembled with the sleeves 306A. With this construction, the surrounding frame 304 can rotate about the hinge 314 relative to the support frame 302 for recline adjustment, and the struts 318 can vertically slide relative to the foot portions 306 during rotation of the surrounding frame 304. Moreover, markings 320 may be provided on one or both strut 318 to visually indicate the recline position setting in the child seat 300.

Figure 17:
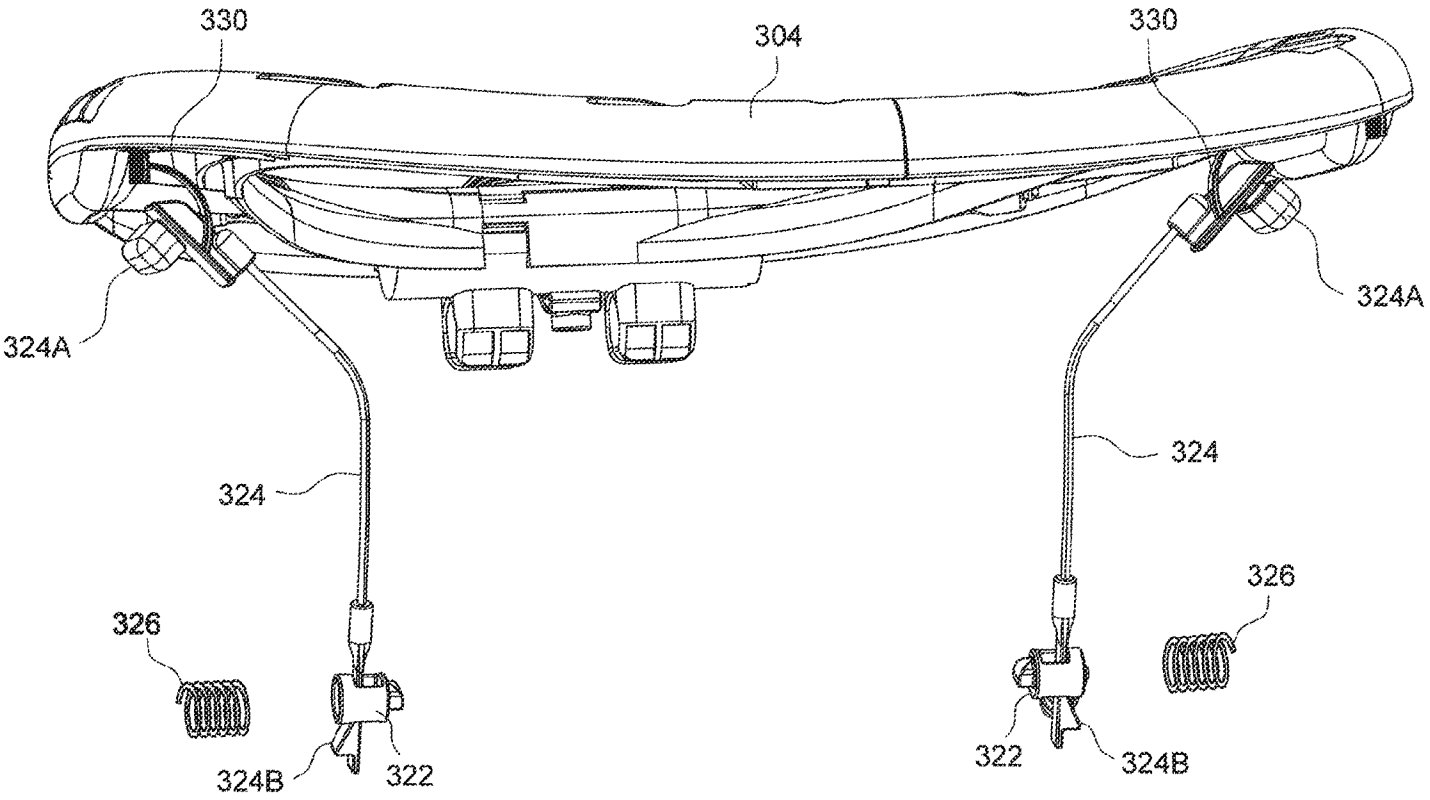
FIG. 17 is a schematic view illustrating a latching mechanism for locking the child seat of FIG. 15 at any one of multiple recline positions.

In conjunction with FIGS. 15 and 16, FIG. 17 is a schematic view illustrating a latching mechanism for locking the child seat 300 at any one of multiple recline positions. Referring to FIGS. 15-17, the latching mechanism can include two latches 322 respectively assembled with the two struts 318 for transversal sliding movement, two release actuators 324 respectively disposed along the interior of the two struts 318, and two springs 326 respectively connected with the latches 322 and inner sidewalls of the struts 318. The latches 322 can be respectively biased by the springs 326 to engage with holes 328 provided on the two sleeves 306A of the foot portions 306, thereby locking the surrounding frame 304 in position with the support frame 302. For adjusting the recline position of the surrounding frame 304, the release actuators 324 can be manually pushed upward at their upper ends 324A, which causes ramped surfaces 324B provided at lower ends of the release actuators 324 to respectively push the latches 322 to disengage from the sleeves 306A of the foot portions 306. Then the unlocked surrounding frame 304 can be rotated about the hinge 314 until it reaches a desired recline position. Once the surrounding frame 304 is in the desired reclined position, the latches 322 can respectively engage with the corresponding holes 328 on the sleeves 306A to lock the surrounding frame 304 with the support frame 302. Springs 330 connected with the release actuators 324 can bias the release actuators 324 downward to their initial position corresponding to a locking state of the latches 322.

Advantages of the structures described herein include the ability to provide a child motion apparatus that can receive the installation of a detachable child seat, and has two independent actuating mechanisms for driving horizontal swing and vertical movements of the child seat. The two actuating mechanisms are similar in construction, and can operate individually or together to produce a wide variety of motions for the child seat. Moreover, the child seat of the child motion apparatus can be used separately as a standalone rocking chair, which can make the system more versatile in use.

Realizations of the child motion apparatus have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. A child motion apparatus comprising:

a base frame assembly for providing standing support on a floor;

a column connected with the base frame assembly;

a support arm extending generally horizontally relative to the column, the support arm having a first and a second end portion, the first end portion being assembled with the column and having a channel extending generally vertically, the support arm further being connected with the column via a hinge about which the support arm is rotatable generally horizontally relative to the column;

a child seat connected with the second end portion of the support arm;

a vertical actuating mechanism supported by the base frame assembly and operable to drive the column to slide upward and downward relative to the base frame assembly; and a horizontal actuating mechanism operable to drive the support arm to oscillate generally horizontally relative to the column, the horizontal actuating mechanism including a driving part movable along a circular path and guided for sliding movement along the channel at the first end portion of the support arm, wherein a circular motion of the driving part causes the driving part to slide along the channel and thereby drives an oscillating movement of the support arm.

2. The child motion apparatus according to claim 1, wherein the channel has a length that encompasses a diameter of the circular path.

3. The child motion apparatus according to claim 1, wherein the driving part is a roller or a ball bearing.

4. The child motion apparatus according to claim 1, wherein the horizontal actuating mechanism further includes:

an electric motor having an output shaft; and a transmission assembly respectively coupled with the output shaft of the electric motor and the driving part, the transmission assembly including a gear rotatable about an axis extending generally horizontally, the driving part being attached to the gear.

5. The child motion apparatus according to claim 4, wherein the transmission assembly further includes:

a first pulley affixed with the output shaft of the electric motor;

a worm shaft having a worm and affixed with a second pulley;

a belt connected with the first and second pulleys;

a worm gear meshed with the worm; and a second gear rotationally coupled with the worm gear, the second gear meshing with the gear attached to the driving part.

6. The child motion apparatus according to claim 1, wherein the column includes a second channel, and the vertical actuating mechanism includes a second driving part movable along a second circular path and guided for sliding movement along the second channel.

7. The child motion apparatus according to claim 6, wherein the second channel of the column extends generally horizontally.

8. The child motion apparatus according to claim 6, wherein the driving part of the horizontal actuating mechanism and the second driving part of the vertical actuating mechanism respectively move in two generally vertical planes that are parallel or substantially parallel to each other.

9. The child motion apparatus according to claim 6, wherein the second channel extends generally horizontally, and has a length that encompasses a diameter of the second circular path.

10. The child motion apparatus according to claim 6, wherein the second driving part is a roller or a ball bearing.

11. The child motion apparatus according to claim 6, wherein the vertical actuating mechanism further includes:

a second electric motor having a second output shaft; and a second transmission assembly coupled with the second output shaft of the second electric motor and including a crank rotatable about an axis extending generally horizontally, the second driving part being attached to the crank.

12. The child motion apparatus according to claim 11, wherein the second transmission assembly further includes:

a third pulley affixed with the second output shaft;

a second worm shaft having a second worm and affixed with a fourth pulley;

a second belt connected with the third and fourth pulleys; and a second worm gear meshed with the second worm and rotationally coupled with the crank.

13. The child motion apparatus according to claim 1, wherein the column includes a plurality of pockets, and the support arm includes a plurality of converging portions respectively in contact with the pockets to form the hinge allowing generally horizontal rotation of the support arm relative to the column, the respective contacts between the converging portions and the pockets being substantially aligned with each other along a vertical axis.

14. The child motion apparatus according to claim 1, wherein the second end portion of the support arm is affixed with a seat mount, and the child seat is affixed with a connector, the connector being engageable with the seat mount in different orientations of the child seat relative to the column.

15. The child motion apparatus according to claim 1, wherein the base frame assembly includes a housing, and one or more stabilizing foot detachably connected with the housing.

16. The child motion apparatus according to claim 1, wherein the child seat includes a support frame having two curved foot portions, the curved foot portions allowing the child seat to rock on a floor surface when the child seat is removed from the support arm and used as a standalone chair.

17. The child motion apparatus according to claim 16, wherein the second end portion of the support arm is affixed with a seat mount, and the child seat further includes a connector disposed between the two foot portions, the connector being engageable with the seat mount in different orientations of the child seat.

18. The child motion apparatus according to claim 17, wherein the child seat further includes a surrounding frame pivotally connected with the support frame, the surrounding frame being rotatable relative to the support frame for recline adjustment.

19. The child motion apparatus according to claim 18, wherein the child seat further includes two vertically slidable struts respectively connected with a left and a right side of the surrounding frame and the two foot portions, and at least one latch operable to lock the surrounding frame with the support frame in a recline position.

20. The child motion apparatus according to claim 1, wherein the horizontal actuating mechanism further includes:

an electric motor having an output shaft;

a transmission assembly respectively coupled with the output shaft of the electric motor and the driving part, the transmission assembly including a first and a second gear, the second gear being affixed with the driving part; and a housing respectively assembled with the electric motor and the first gear, the housing being connected with a casing of the column via an attachment that allows a limited rotation of the housing relative to the casing sufficient to disengage the first gear from the second gear.

21. A child motion apparatus comprising:

a base frame assembly for providing standing support on a floor;

a column connected with the base frame assembly;

a support arm extending generally horizontally relative to the column, the support arm having a first and a second end portion, the first end portion being assembled with the column and having a first channel extending generally vertically, the support arm further being connected with the column via a hinge about which the support arm is rotatable generally horizontally relative to the column;

a child seat connected with the second end portion of the support arm;

a horizontal actuating mechanism operable to drive the support arm to oscillate generally horizontally relative to the column, the horizontal actuating mechanism including a first driving part movable along a first circular path and guided for sliding movement along the first channel, wherein a circular motion of the first driving part causes the first driving part to slide along the first channel and thereby drives an oscillating movement of the support arm; and a vertical actuating mechanism supported by the base frame assembly and operable to drive the column to slide upward and downward relative to the base frame assembly, the vertical actuating mechanism including a second driving part movable along a second circular path and guided for sliding movement along a second channel affixed with the column, the second channel extending generally horizontally.

22. The child motion apparatus according to claim 21, wherein the first channel has a first length that encompasses a diameter of the first circular path, and the second channel has a second length that encompasses a diameter of the second circular path.

23. The child motion apparatus according to claim 21, wherein the first and second driving parts respectively move in two generally vertical planes that are parallel or substantially parallel to each other.

24. The child motion apparatus according to claim 21, wherein the column includes a plurality of pockets, and the support arm includes a plurality of converging portions respectively in contact with the pockets to form the hinge allowing generally horizontal rotation of the support arm relative to the column.

25. The child motion apparatus according to claim 21, wherein any of the first and second driving part is a roller or a ball bearing.

26. The child motion apparatus according to claim 21, wherein the horizontal actuating mechanism further includes:

an electric motor having an output shaft;

a transmission assembly respectively coupled with the output shaft of the electric motor and the first driving part, the transmission assembly including a first and a second gear, the second gear being affixed with the first driving part; and a housing respectively assembled with the electric motor and the first gear, the housing being connected with a casing of the column via an attachment that allows a limited rotation of the housing relative to the casing sufficient to disengage the first gear from the second gear.

27. A child motion apparatus comprising:

a base frame assembly for providing standing support on a floor;

a column connected with the base frame assembly;

a support arm extending generally horizontally relative to the column, the support arm having a first and a second end portion, the first end portion being assembled with the column, and the second end portion having a seat mount;

a vertical actuating mechanism supported by the base frame assembly and operable to drive the column to slide upward and downward relative to the base frame assembly;

a horizontal actuating mechanism operable to drive the support arm to oscillate generally horizontally relative to the column, each of the horizontal actuating mechanism and the vertical actuating mechanism being electrically driven in an independent manner; and a child seat detachably installable on the seat mount of the support arm, wherein the child seat includes a support frame having two curved foot portions, a surrounding frame connected with the support frame, and a connector disposed between the two foot portions, the connector being engaged with the seat mount when the child seat is installed on the support arm and disengaged from the seat mount when the child seat is removed from the support arm, the curved foot portions providing independent support for the child seat and allowing the child seat to rock on a floor surface when the child seat is removed from the support arm and used as a standalone chair.

28. The child motion apparatus according to claim 27, wherein the surrounding frame is pivotally connected with the support frame, the surrounding frame being rotatable relative to the support frame for recline adjustment.

29. The child motion apparatus according to claim 28, wherein the child seat further includes two vertically slidable struts respectively connected with a left and a right side of the surrounding frame and the two foot portions, and at least one latch operable to lock the surrounding frame in position with the support frame.

30. The child motion apparatus according to claim 27, wherein the child seat is a rocking chair.

31. The child motion apparatus according to claim 27, wherein an oscillating movement of the support arm relative to the column displaces the child seat along a curved path around the column.

32. The child motion apparatus according to claim 27, wherein the child seat is installable on the seat mount in different orientations.

33. The child motion apparatus according to claim 27, wherein each of the horizontal actuating mechanism and the vertical actuating mechanism is electrically driven in an independent manner with a different electric motor.

34. A child motion apparatus comprising:

a base frame assembly for providing standing support on a floor;

a column connected with the base frame assembly;

a support arm extending generally horizontally relative to the column, the support arm having a first and a second end portion, the first end portion being assembled with the column, and the second end portion having a seat mount, the seat mount having a protuberance;

a vertical actuating mechanism supported by the base frame assembly and operable to drive the column to slide upward and downward relative to the base frame assembly;

a horizontal actuating mechanism operable to drive the support arm to oscillate generally horizontally relative to the column, each of the horizontal actuating mechanism and the vertical actuating mechanism being electrically driven in an independent manner; and a child seat affixed with a connector having an opening, the child seat being detachably installable on the seat mount with the protuberance engaged into the opening, the protuberance and the opening having mutually engaging shapes that are rotationally symmetrical so that the child seat is installable on the seat mount in different orientations.

35. The child motion apparatus according to claim 34, wherein the protuberance includes a cross shape, a star shape or a square shape.

36. The child motion apparatus according to claim 34, wherein the child seat includes a support frame having two foot portions, the connector being disposed at a middle position between the two foot portions.

* * * * *